United States Patent [19]

Kewish et al.

[11] Patent Number: 4,992,041

[45] Date of Patent: Feb. 12, 1991

[54] METHOD AND APPARATUS FOR PRODUCING A WOOD-LIKE FLAME APPEARANCE FROM A FIREPLACE-TYPE GAS BURNER

[75] Inventors: Steven A. Kewish, Gates Mills; Alice M. Waters, South Euclid; Stephen R. Walzer, Brunswick; Roger D. Sheridan; Robert B. DeRemer, both of Maple Heights; James R. Hatfield, Breckiville, all of Ohio

[73] Assignee: Gas Research Institute, Chicago, Ill.

[21] Appl. No.: 437,699

[22] Filed: Nov. 13, 1989

[51] Int. Cl.[5] ..... F23Q 2/08

[52] U.S. Cl. ..... 431/126; 431/347; 431/4; 126/92 R

[58] Field of Search ..... 431/126, 125, 347, 4; 126/503, 92 R

[56] References Cited

U.S. PATENT DOCUMENTS

| | | | |
|---|---|---|---|
| 249,362 | 11/1881 | Jackson . | |
| 312,452 | 2/1885 | Fannehjelm . | |
| 808,513 | 12/1905 | Cox | 431/126 |
| 2,391,988 | 1/1946 | Loane . | |
| 2,463,988 | 3/1949 | Marek . | |
| 3,747,585 | 7/1973 | Coats . | |
| 3,831,582 | 8/1974 | Mahoney | 126/503 |
| 3,925,001 | 12/1975 | Salooja . | |
| 4,472,135 | 9/1984 | Parker et al. . | |
| 4,525,141 | 6/1985 | DeWerth et al. . | |
| 4,629,415 | 12/1986 | DeWerth . | |

FOREIGN PATENT DOCUMENTS

| | | |
|---|---|---|
| 12742 | 10/1902 | United Kingdom . |
| 3474 | 2/1912 | United Kingdom . |
| 170138 | 10/1921 | United Kingdom . |
| 216968 | 6/1924 | United Kingdom . |
| 988779 | 4/1965 | United Kingdom . |
| 1067642 | 5/1967 | United Kingdom . |
| 2049912 | 12/1980 | United Kingdom . |

OTHER PUBLICATIONS

CRC Handbook of Chemistry & Physics 69th Ed., 1988–1989, p. D–129.

*Primary Examiner*—Carroll B. Dority
*Attorney, Agent, or Firm*—Mason, Fenwick & Lawrence

[57] ABSTRACT

An apparatus for coloring gas flames in gas-burning fireplaces so as to give the appearance of a wood-burning fireplace comprises a ceramic tube having a coating which causes colorization of gas flames when the coated tube is placed in the secondary reaction zone of a gas flame. Principle coating ingredients include sodium carbonate, aluminum oxide, pulverized soda lime glass, and sodium silicate. The coating is baked onto the ceramic tube, and, when located in the secondary reaction zone of a flame, will provide nearly constant natural color to a gas flame for periods in excess of 1000 hours.

21 Claims, 2 Drawing Sheets

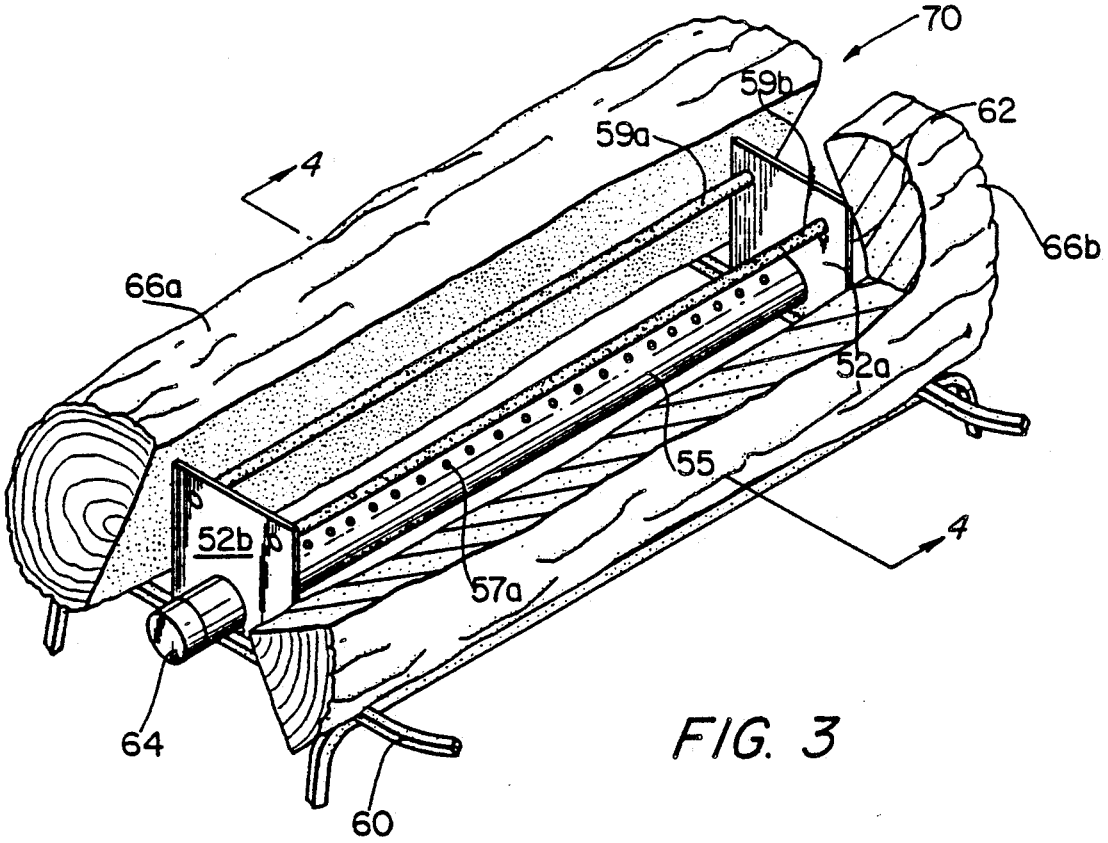
FIG. 3
FIG. 4
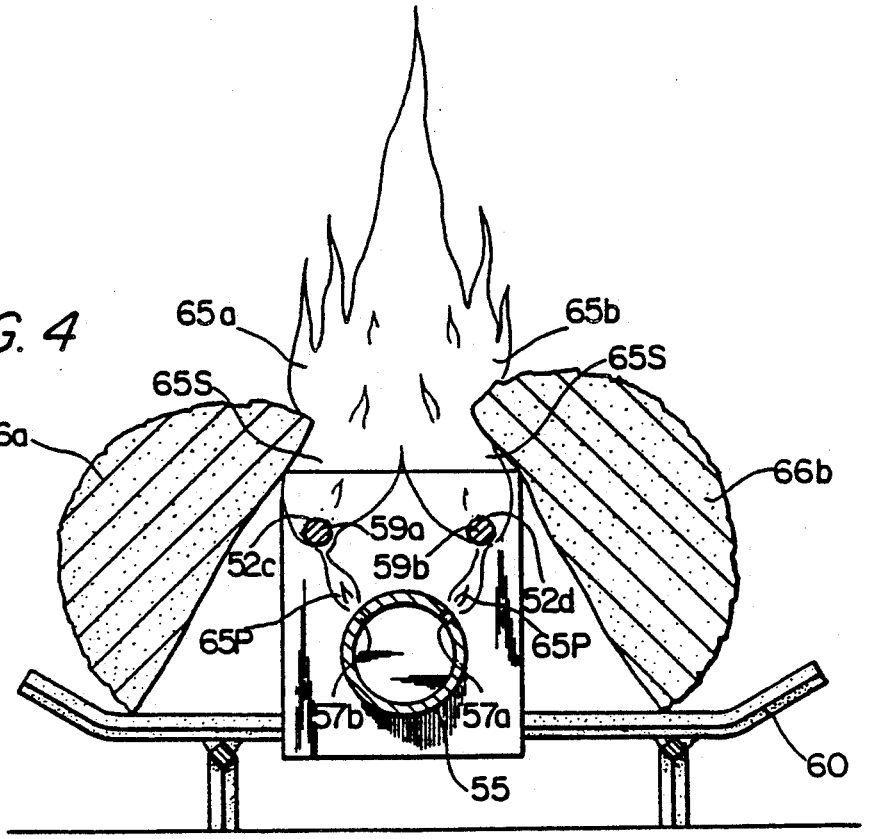

METHOD AND APPARATUS FOR PRODUCING A WOOD-LIKE FLAME APPEARANCE FROM A FIREPLACE-TYPE GAS BURNER

FIELD OF THE INVENTION

This invention relates to flame-coloring devices in general, and relates more particularly to a device for use in gas fireplaces for altering the color and appearance of the flame to resemble that of the flame produced by burning wood.

BACKGROUND OF THE INVENTION

Traditional wood-burning fireplaces are enjoyed for their attractive appearance, the "atmosphere" that their use creates, and their heat producing ability. However, there are many drawbacks to wood-burning fireplaces, among them the necessity for cleaning the chimney of soot to prevent chimney fires, and the build-up of wood ash in the hearth which must be periodically removed. In addition, wood for a fireplace is usually more expensive in urban settings than other fuels, such as gas, and it is difficult, or impossible, to install wood-burning fireplaces in many areas. Furthermore, wood is not completely combusted in most wood-burning fireplaces, and this produces ash and soot which enter the atmosphere and contribute to pollution.

On the other hand, gas-burning fireplaces can be installed in a wider variety of locations, burn more efficiently to produce a greater amount of heat, are easier to maintain, produce less pollutants, and are less expensive to utilize. However, the clean, hot flame produced by a gas burner does not have the same attractive appearance or provide the warm glow effect of the yellow/orange colored flame of a conventional wood-burning fireplace. Furthermore, the burner assembly of a gas-burning fireplace is not as attractive as a pile of wood blazing in the hearth of a wood-burning fireplace.

In an effort to enable gas-burning fireplaces to have a closer resemblance to wood-burning fireplaces, Coats, in U.S. Pat. No. 3,747,585, disclosed a simulated, non-combustible log structure supported above the burner of a gas-burning fireplace. Flames are permitted to contact the underside of the artificial logs to provide for a more realistic simulation of a wood-burning fireplace. However, no provision was made to color or modify the gas flames to resemble those produced from burning wood.

British Pat. No. 12,742, awarded to Oelbermann in 1902, noted that it was already old to color flames using a great variety of substances; these include metal salts or ashes, such as compounds of lithium, strontium, barium, copper, thorium, cerium, etc. Oelbermann produced a colored flame by projecting a holder filled with flame-coloring substances into a candle flame. However, this required an elaborate apparatus to maintain the holder in the candle flame since the candle would shrink in height as it was consumed.

Parker et al., in U.S. Pat. No. 4,472,135, improved upon the teachings of Oelbermann to produce a flame-coloring device for gas burners which makes the flame visible even when the burner is used outdoors or in a bright environment. A carrier is placed on the burner barrel, and a solid colorant emitter such as sodium chloride is supported by the carrier. However, the flame-coloring device has only been demonstrated to color flames of small conventional bunsentype burners. Furthermore, the colorant emitter used by Parker et al. is not heat-stable and may become molten at the temperatures employed to cause the colorant to drip off of the carrier, possibly clogging the burner and soiling the area surrounding the burner while also rapidly exhausting the flame colorant.

Salooja, in U.S. Pat. No. 3,925,001 recognized that heat-stable metal compounds could be used to catalytically improve the combustion of carbonatious fuels when applied to a support which is then placed in the center of the primary reaction zone of a flame. The catalytically active material is selected from compounds of barium and sodium, barium and yttrium, barium and erbium, aluminum, aluminum and yttrium, aluminum and lanthanum, aluminum and erbium, aluminum and platinum, gallium and sodium, zirconium and yttrium, zirconium and erbium, zirconium and chromium, zirconium and manganese, zirconium and iron, zirconium and platinum, manganese and sodium, manganese and yttrium, manganese and titanium, manganese and chromium, manganese and iron, manganese and nickel, and palladium and iron.

A critical aspect of Salooja's disclosure is the correct placement of the catalytically active material in the flame. Salooja recognized that all gas flames have a general structure comprised of three zones:

1. A cool zone at the base of the flame where air and fuel are mixed without substantial fuel combustion;
2. A primary reaction zone, adjacent to the base of the flame; this is the hottest part of the flame since combustion is most vigorous here and the concentration of ions is at a maximum; and
3 Asecondary reaction zone, above and adjacent to the primary reaction zone; this is the most luminous part of a flame, and is usually substantially cooler than the primary reaction zone. If there is insufficient air, or if combustion is not complete, smoke and soot would appear above the secondary reaction zone. Only by placing Salooja's catalyst impregnated support in the primary reaction zone of a flame will there be a reduction in the production of soot and smoke and an increase in the efficiency of flame combustion. The catalyst impregnated support of Salooja will not work correctly if placed outside of the primary reaction zone, nor does it assist in coloring the flame.

Wood-burning flames generally burn cooler than gas flames and have larger secondary reaction zones due to the incomplete combustion of the wood components. However, gasburning fireplaces generally do not suffer from incomplete fuel combustion, nor do they generate significant quantities of smoke or soot. In fact, their high temperatures and efficient utilization of fuel causes the secondary reaction zone of a gas-burning fireplace flame to be almost invisible. For example, the primary reaction zone of a natural gas flame burning in air may achieve temperatures in excess of 3400° F. (depending on the fuel to oxidant ratio) while the secondary reaction zone may have temperatures ranging down to approximately 1000° F.

The high temperatures achieved in a gas-burning fireplace may pose potential fire and explosion hazards if the fireplace is not correctly designed and used. As a result, gas-burning fireplaces should meet appropriate safety standards such as those set by the American National Standards Institute, ANSI. Existing flame-coloring methods, if they were to be used in conjunction with an ANSI approved gas burner, may not be capable of certification under ANSI or other safety standards.

There is thus a need for a gas-burning fireplace in which fuel is burned efficiently and cleanly, but which also has a secondary reaction zone which has the color and appearance of a wood-burning flame. There is also a need for a device which can provide uniform flame coloration for extended periods of time, can be easily replaced, is safe to use, and which has a flame-coloring substance which will not, when exposed to a flame, rapidly decompose, or flake and/or drip off to clog the burner and/or soil the surrounding area. A fireplace using such a device would combine the economical and improved heating capabilities of a gas-burning fireplace with the aesthetic beauty associated with wood-burning fireplaces.

SUMMARY OF THE INVENTION

The preferred embodiment of the present invention is directed to a flame-coloring device which is intended for use in gas-burning fireplaces. A hollow ceramic tube is provided as a support for a coating which, when placed in the secondary reaction zone of a gas-burning fireplace flame, allows for the controlled release of sodium ions to provide for flame-coloration. The coated support tube serves to provide a residence for the flame-coloring coating, and will not interfere with fuel combustion in the flame; the tube has mechanical strength at the high operating temperatures of the flame, and the coating resists degradation, flaking or melting and consequent running off. The support coating is a mixture of sodium carbonate ($Na_2CO_3$) and aluminum oxide ($Al_2O_3$) in pulverized soda lime glass, and sodium metasilicate ($Na_2SiO_3$). The coating may also employ a mixture of sodium bicarbonate ($NaHCO_3$) in place of, or in combination with, sodium carbonate; sodium metasilicate may be replaced or combined with sodium silicate ($Na_2O{\cdot}xSiO_2$ where $x=3-5$), hydrated sodium metasilicate ($NaSiO_3{\cdot}9H_2O$) or sodium disilicate ($Na_2O{\cdot}2SiO_2$). A support made from mullite may be substituted for the ceramic support.

The coloring compound is applied to the support soon after its ingredients have been mixed and hydrated. After the mixture has dried onto the support surface, the coated supports are baked to bond the composition to the support; this provides a unique composition which will provide nearly constant natural color to a gas flame for an extended time period when the coated support is suspended in the secondary reaction zone of the flame produced by a burner in a gas fireplace.

When the flame-coloring device is placed in the secondary reaction zone, which is located above the primary reaction zone of a flame, flames contacting the support will excite sodium atoms and/or other flame-coloring compounds in the coating so as to release them into the flame where they undergo ionization. When the sodium ions in the flame relax, they emit light having a specific wavelength characteristic for sodium and impart a yellow/orange glow to the flame. A variety of other flame-coloring compounds, such as other metals, metal compounds and organometallics, may be used as well; the color of the flame will depend on what coloring compound is used.

The flame-coloring device is designed so as to be nearly undetectable to the casual observer. The burner and one or more flame-colorizing tubes may be situated behind and/or under a decorative, fireproof assembly to hide, or at least partially hide the burner and flame-coloring device; for example, a stack of artificial "logs" made of fire resistant material can be situated in front of and above the colorized flame in order for the gas-burning fireplace to more closely resemble the appearance of a wood-burning fireplace.

It is a primary object of this invention to provide an apparatus for coloring flames produced in gas-burning fireplaces which does not interfere with or effect fuel combustion.

It is a further object of the subject invention to provide a flame-coloring device for gas-burning fireplaces which is superior in longevity and ease of use.

It is still another object of the subject invention to provide a gas flame-coloring compound, made from readily available chemical reagents, which is easily formulated and easily applied to a suitable support so that it may then be placed in a flame to color it.

It is yet another object of the subject invention to provide a coloring device for gas-burning fireplace flames which is simple in nature and relatively inexpensive to manufacture.

It is a still further object of the subject invention to provide a flame-coloring device for gas-burning fireplaces which provides a flame resembling that produced by a wood-burning fireplace, yet provides the heat output and fuel-burning efficiency of a gas-burning fireplace.

It is a still further object of the subject invention to provide a flame-coloring compound and method for applying it to a support so as to prevent the compound from rapid volatilization, and flaking or running off of the support when the support is placed in the flame of a gas-burning fireplace.

Other objects and advantages of the subject invention will become apparent from the accompanying drawings and detailed description in which like reference numerals are used for the same parts as illustrated in the various figures.

BRIEF DESCRIPTION OF THE DRAWINGS

FIG. 3 is a perspective view of a portion of a second embodiment of the invention incorporated into a gas-burning fireplace and including a decorative artificial log assembly; and FIG. 4 is a partial cross sectional view of the second embodiment of the invention taken along lines 4—4 of FIG. 3.

DETAILED DESCRIPTION OF THE INVENTION

Figure 1:
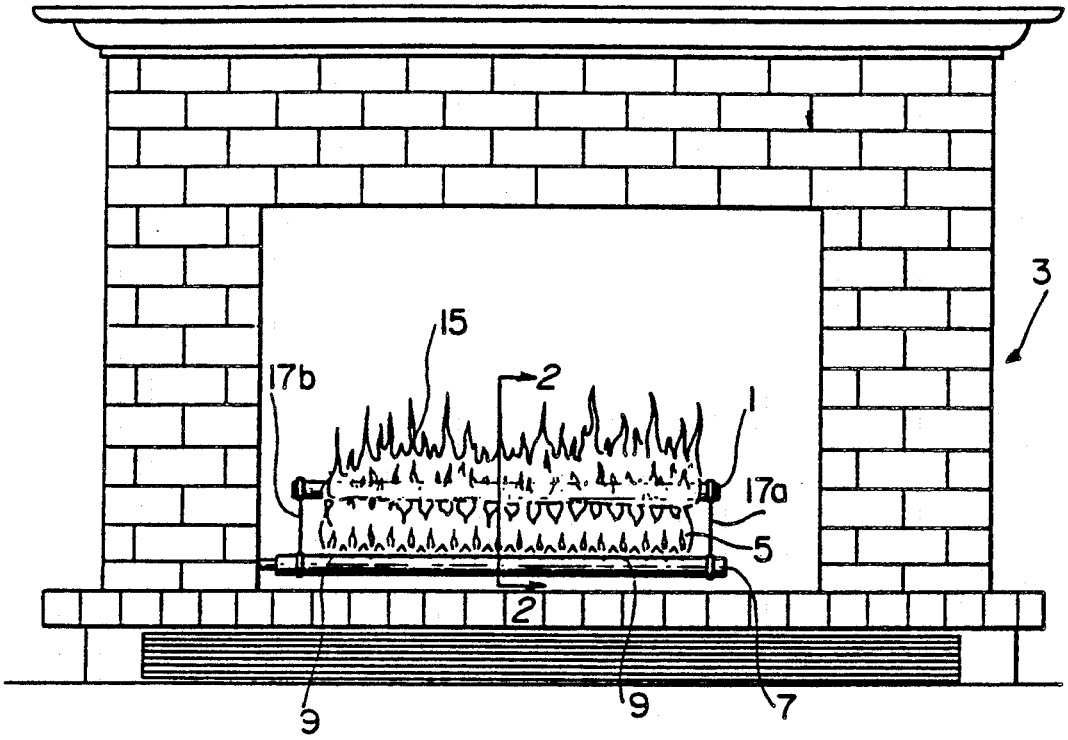
FIG. 1 is a front elevation view of a first embodiment of the invention incorporated into a gas-burning fireplace.

FIG. 1 illustrates the first embodiment comprising a flame-coloring device 1 installed in a fireplace 3. A flame 5 is produced by a conventional burner 7 which is located at a distance beneath flame-coloring device 1. Flame 5 emanates from holes 9 on burner 7. An igniter (not shown) may be utilized to automatically light the flame 5, when fuel is provided to the burner.

Figure 2:
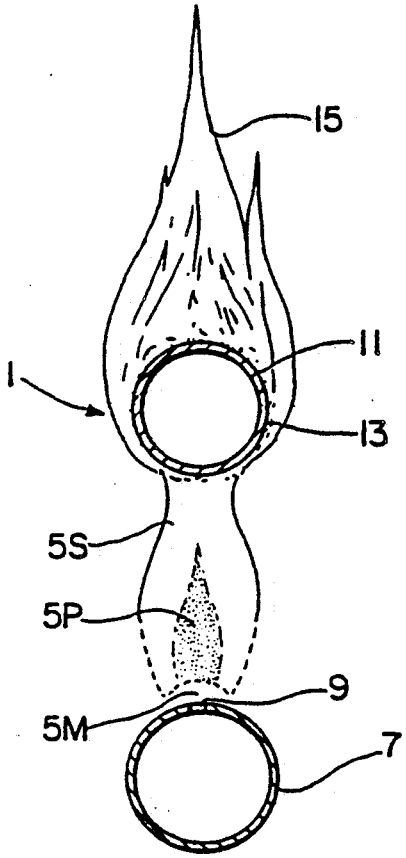
FIG. 2 is a sectional view of the first embodiment of the flame-coloring device with a flame impinging upon it taken along lines 2—2 of FIG. 1.

With further reference to FIG. 2, the flame 5 emanating from burner 7 has a mixing zone 5M adjacent to gas discharge holes 9; the mixing zone 5M is generally invisible to the eye and is the coolest part of the flame. A primary reaction zone 5P is adjacent to and above the mixing zone 5M; due to the vigorous combustion of the fuel and air mixture, the primary reaction zone 5P is the hottest part of the flame.

The high temperatures caused by the rapid combustion of the fuel air mixture generates flame 5 which has a blue color in the primary reaction zone 5P. A secondary reaction zone 5S surrounds the primary reaction zone 5P, and, due to the almost complete combustion of fuel in the primary reaction zone 5P, is almost invisible to the naked eye. By reduction of the amount of air in the fuel-air mixture, less air is consumed in the primary reaction zone 5P, and a lower-temperature flame results. The cooler flame may result in a secondary reaction zone 5S which has a yellow/orange appearance. However, producing a colored flame in this manner may lead to incomplete combustion which wastes fuel, generates less heat, and pollutes the atmosphere due to the release of incompletely combusted hydrocarbon materials. It is preferred that the gas flame utilized have its fuel to oxidant ratio adjusted so as to achieve as efficient and complete fuel combustion as possible.

The flame-coloring device 1 is placed parallel to and above the burner 7 at a height which allows only the secondary reaction zone 5S of flame 5 to impinge upon the device 1. A variety of structures that would be obvious to those of skill in the art can be used to suspend the flamecoloring device 1 above burner for example, a wire support frame, or the like, could be attached to burner 7 for this purpose. It is important that the flame-coloring device 1 not be placed into the primary reaction zone 5P as this may interfere with the complete and efficient combustion of the fuel and would accelerate the degradation of the flame-coloring device 1.

The flame-coloring device 1 comprises a coating 11 on a support 13. The support 13 is a cylindrical ceramic tube comprised primarily of aluminum oxide ($Al_2O_3$). Aluminum silicate (also referred to as mullite, $3Al_2O_3 \cdot 2SiO_2$), or reticulated silicon carbide (SiC), may substitute for the ceramic material. Although metals may be used for support 13, they suffer from thermal expansion problems when heated in the flames, sometimes causing the coating to flake off. Although a cylindrical tube is the preferred shape for support 13, a variety of shapes and sizes for support 13 may be used which may be placed in the parallel plane above the holes in a gas burner so that the coated support is exposed to only the secondary reaction zone of the flame. Alternatively a plurality of flame-coloring compound coated supports may be placed in the secondary reaction zone of a gas-burning fireplace flame.

It is not necessary for the flame-coloring device 1 to be placed directly in the parallel plane above holes 9 and burner 7 so long as support 13 is located in the secondary reaction zone 5S of flame 5. An alternative way in which the flame-colorizing device 1 may be used is for indirect colorization of flames; this can be achieved by locating support 13 and flame 5 below or directly adjacent to a second flame (not shown). Both flames would be colored as their secondary reaction zones merged. This effect may be enhanced even further by adjusting flame 5 so that it has a high oxidant to fuel ratio to produce a tight, well-defined flame pattern. The second flame (not shown) would be adjusted for low oxidant to fuel ratio, and would use larger burner ports, to produce a large fluttering flame.

It should also be noted that holes 9 on burner 7 can be positioned so that flame 5 projects at an angle from burner 7; this produces a larger secondary reaction zone and more closely resembles the fluttering irregular flame produced by a wood-burning fire.

The coating 11 is made from sodium carbonate ($Na_2CO_3$) mixed with aluminum oxide ($Al_2O_3$) in pulverized soda lime glass, and a warm, saturated sodium metasilicate solution ($Na_2SiO_3$). The resulting solution is applied to ceramic support 13 and baked at approximately 500° F. until dry. A support 13 with a coating 11 prepared in this matter may then be placed in the secondary reaction zone 5S of flame 5 to produce in excess of 1000 hours of coloration.

Instead of baking the support 13 with coating 11 at approximately 500° F. until dry, the coating 11 on support 13 may be dried at 100° F. The wet solution applied to the support 13 is gelatinous in nature and may be dried at temperatures ranging from room temperature up to approximately 100° F. to form a coating 11 which is dry to the touch. However, if a coating 11 on a support 13, which is dried at these low temperatures, is placed into the secondary reaction zone 5S of flame 5, without being treated at temperatures in the range of 200° F. to 600° F. first, the coating 11 is likely to spatter or flake off in the flame 5. Therefore, it is recommended that the coated supports be treated at temperatures between the range of 200° and 600° F. before exposure to the flame. The spattering from coatings not baked at 200° F. to 600° F. first may be due to the formation of gases or the rapid loss of water from the coating 11 at higher temperatures, or is due to a rapid change in molecular structure.

Coatings applied to support 13, and allowed to dry at room temperature or at temperatures up to, but not exceeding, 200° F. tend to resolubilize in water. However, supports with a coating baked at temperatures in excess of 200° F., especially at temperatures of approximately 500° F., appeared to be irreversibly dehydrated and did not resolubilize when exposed to water. Nevertheless, the baked, coated tubes should be kept free from moisture to avoid flaking problems which may occur if placed in a flame while still wet. By adjusting the temperature and time of the bake, it is possible to optimize the time and temperature parameters for forming a stable flame-colorizing coating upon a support which will be stable at the higher operating temperatures of the flames that it is placed in.

In the alternative, the coating 11 may be formed by adding sodium bicarbonate ($NaHCO_3$), to a mixture of aluminum oxide ($Al_2O_3$), in pulverized soda lime glass. Sodium silicate solution ($Na_2O \cdot xSiO_2$ where $x=3-5$) is then added to this mixture to form a viscous solution. The viscous solution is then applied to a ceramic or mullite support, which is in the shape of an elongated tube, and allowed to dry. The coated support is then baked at 550° F. for 15 minutes in a vertical orientation. Standing the tubes in a vertical orientation helps to provide a uniform coating thickness around the circumference of the tube while allowing for excess coating to drip off. By altering the coated tube's position prior to drying, it is possible to ensure a more uniform coating along the length of the tube.

Gas-burning fireplaces such as represented here by the number 3 would generally have the flame-coloring device 1 installed at the factory, and the distance between the burner 7 and flame-coloring device 1 would generally be adjusted upon its installation in the gas-burning fireplace. Brackets 17*a* and 17*b* are attached to the ends of the flame-coloring device 1 and near the ends of burner 7. The adjustment mechanism is not shown since any conventional method of adjustably supporting one object above another may be used. Since the flame-coloring device uses a hollow support 13, it is also possible to use brackets which are inserted into the ends of the supports 13 to hold them up.

Once the fuel-air mix is set in a gas-burning fireplace with a factory installed flame-coloring device, it is anticipated that the location of the secondary reaction zone 5S and the primary reaction zone 5P will remain stable, and not require adjustment of the height of the flame-coloring device 1 with every use. It is envisioned that suitable instructions would be included with all such gas-burning fireplaces 3 with flame-coloring devices 1 to enable a user to easily adjust the height of the flame-coloring device 1 to maintain it in the secondary reaction zone 5S.

Care must be taken to keep the flame-coloring device 1 out of the primary reaction zone 5P, as this will greatly accelerate the degradation of the coating 11, and may cause the support 13 to sag or break. Additional brackets (not shown) may be placed every eight to ten inches along the support; this may be especially useful for longer flame-coloring devices.

Flame-coloring compounds have been formulated from the following ingredients given in their relative weight percentages:

30–50% soda lime glass,
20–35% aluminum oxide,
5–10% sodium carbonate, and
5–20% sodium metasilicate.

Sodium silicate or sodium disilicate may substitute for sodium metasilicate and sodium bicarbonate may substitute for sodium carbonate. Soda lime glass is a glass made by fusing sand (primarily $SiO_2$) with either sodium carbonate ($Na_2CO_3$), or sodium sulfate ($Na_2SO_4$) and calcium carbonate ($CaCO_3$). The soda lime glass used contained 60–65% silicon dioxide ($SiO_2$), 15–25% sodium oxide ($Na_2O$), and 10–20% calcium oxide (CaO). However, other percentages may be used depending on the source of the soda lime glass.

Water is used as a solvent for the sodium metasilicate, sodium silicate, sodium carbonate and sodium bicarbonate, and also acts as an application vehicle for the mixture of all the ingredients. The sodium in the sodium carbonate, sodium bicarbonate, sodium metasilicate, sodium silicate and the soda lime glass acts as a sodium ion source, while the soda lime glass also provides a calcium ion source. The sodium metasilicate and sodium silicate also act as an adhesive in the low temperature range. It is believed that some of the aluminum oxide, which is very slightly soluble in highly alkaline solutions, may dissolve in the warm, highly alkaline mixture of the soda lime glass, sodium metasilicate and sodium carbonate in water. Subsequent recrystalization and baking of the coating act to create a stronger bond between the coating and the ceramic or mullite tube. In this manner, the aluminum oxide may act as a high temperature adhesive and sodium release moderator; this may also explain the stability of the flame-coloring compound at the higher temperatures.

When a support 13 with coating 11 is placed into a gas flame 5, the coating may take on glass like properties and begin to flow at higher temperatures. Placement of the coated rod in the primary reaction zone 5P of the flame may cause the coating to drip off or flake off into the flame 5, thus, drastically reducing the lifetime of the flame-coloring device 1. The presence of the aluminum oxide in the coating may provide greater shear strength to the coating to increase its viscosity at high temperatures. In addition, other more heat-stable compounds may have been formed between the aluminum oxide and the silicates in the solution, such as sodium aluminum ortho-silicate ($Na_2O{\cdot}Al_2O_3{\cdot}2SiO_2$). The long duration of the flame-coloring capabilities of the coating in gas flames may also be explained by the formation of a glass which slows the rate at which flame-coloring compounds, such as those containing sodium, are released into the flame.

A number of flame-coloring coatings were formulated and applied to ceramic and/or mullite tubes. The following are demonstrative of the large variety of ways in which the flame-coloring coating may be formulated and used.

Example One

A flame-coloring composition was prepared by adding 2.0 grams of sodium carbonate ($Na_2CO_3$), to 10 grams of a 40% by weight mixture of aluminum oxide ($Al_2O_3$), and pulverized soda lime glass. To this mixture add 10.0 milliliters of a warm saturated sodium metasilicate solution ($Na_2SiO_3$) and 0.1 milliliter glycerine (wetting agent). The mixture was kept warm at approximately 150° F., applied to a ceramic tube, and then baked at approximately 500° F. until dry.

Example Two

A 2.0 gram quantity of sodium bicarbonate ($NaHCO_3$) was added to 10 grams of a 50% weight-weight mixture of aluminum oxide ($Al_2O_3$) in pulverized soda lime glass. To this mixture, 0.1 milliliter glycerine and 10.0 milliliters of a 40–42 Be sodium silicate ($Na_2O{\cdot}x{\cdot}SiO_2$ where $x=3-5$) solution were added. The sodium silicate solution used was commercially available at this concentration, but other concentrations may be substituted. The resulting gelatinous mixture was applied to a ceramic or mullite rod, allowed to stand until dry, and then baked at 500° F. for 15 minutes.

Example Three

The solution from Example One and/or the solution from Example Two was coated upon ceramic and/or mullite tubes, and the coated supports were then baked at 500° F. for 15 minutes in a vertical orientation. Once dry, the tubes were kept away from moisture.

The coated tubes from example one, two, and three were then supported above a gas flame burner in the secondary reaction zone of the flame. When in use, tube temperatures were kept at about 1400° F. (experimentally measured with a probe inserted into the tube). It is anticipated that the flame-coloring tubes will be utilized in the secondary reaction zone of flames having temperatures, measured from inside of the tubes, in the range of 1200° F. to 1600° F. Tubes utilized in a gas-burning fireplace in the proceeding manner have provided a continuous color to gas flames for time periods in excess of 1000 hours. Although it is anticipated that the tubes will be used in natural gas or propane flames, the device may be used to color flames produced by other fuels.

In a preferred embodiment, the flame-coloring coating is placed on a hollow ceramic ($Al_2O_3$) tube having dimensions of $\frac{1}{4}''$ outer diameter and $\frac{1}{8}''$ inner diameter; the coating thickness applied to the ceramic tube may range from approximately 1/32" to 1/16" thick. The coating is then dried, baked onto the ceramic tube, and the tube is then suspended in the secondary reaction zone of the flames in a gas fireplace. As the flames impede upon the tube, sodium atoms in the coating are released into the flame where they are ionized; as the ions relax to lower energy levels, a characteristic yellow/orange glow is given off. The invention provides this color in a controlled fashion in order to provide nearly constant natural color for an extended time period. This extended life is due to the unique composition of flame-coloring compound.

With further reference to FIGS. 3 and 4, a second embodiment of a gas flame-coloring device 70 is disclosed. Gas flame-coloring device 70 is shown incorporating two flame-colorizing tubes 59*a* and 59*b* which are held by two rectangular brackets 52*a* and 52*b* above burner element 55. Burner element 55 is an elongated hollow cylinder, and is fed fuel through gas inlet 62. Fuel fed to element 55 is blocked at the opposite of inlet 62 by detachable end cap 64. Cap 64 may be permanently attached or the end of element 55 may be sealed in any other suitable fashion.

The tubes 59*a* and 59*b* may simply rest in the holes 52*c* and 52*d* provided in brackets 52*a* and 52*b*, or the tubes 59*a* and 59*b* may be connected by an alternative means to prevent the tubes from sliding in the bracket holes 52*c* and 52*d*.

Brackets 52*a* and 52*b* may be attached to element 55 by removing end cap 64, and then sliding brackets 52*a* and 52*b* onto element 55. Brackets 52*a* and 52*b* may be welded in place, or they may have a snug enough fit on burner element 55 so that they project upwardly above burner element 55 in a fixed position. This same result may be achieved by fitting brackets 52*a* and 52*b* over protuberances, or into recesses, on burner element 55.

Holes 52*c* and 52*d* are shown having fixed locations in the rectangular brackets 52*a* and 52*b* as the brackets 52*a* and 52*b* are designed to be installed at the factory which produces the gas-burning fireplace; since the burner 55 is preadjusted at the factory, brackets 52*a* and 52*b* will hold the flame-colorizing tubes 59*a* and 59*b* in the secondary reaction zone 5S of a flame produced by burner 55.

It is envisioned that a wide variety of brackets may be used to support the flame-coloring tubes in the secondary reaction zone of a flame. Adjustable brackets can be used since it may be necessary to adjust the height of the flame-colorizing tubes 59*a* and 59*b* above the burner element 55 to maintain the tubes 59*a* and 59*b* in the secondary reaction zone of the flame. This is especially important for gas-burning fireplaces which are not assembled at a factory, or when the flame-coloring device of the present invention is retrofitted to an existing gas burner.

Gas flame-coloring device 70 rests upon fireplace grate 60. The coloring device 70 may be partially or completely hidden from view by a decorative, fireproof assembly such as artificial logs 66*a* and 66*b*. Artificial logs 66*a* and 66*b* can be made of concrete, ceramic fibers, or any suitable flame resistant material. Logs made from a mixture of sand, gravel, and portland cement have been used with satisfactory results.

When flame-coloring device 70 is concealed by logs 66*a* and 66*b*, it may be necessary to increase the flame size. This can be done by increasing input rate and/or the port area on the burners used. Larger burners may be necessary for a uniform flame pattern if input rate and port area requirements exceed burner capacity. Note that high port loading results in a long, fluttering flame. However, if port loading is too high, flame lifting, yellow tipping, unacceptable combustion, and unreliable ignition might occur. The asthetic and operational characteristics of the flame can be optimized by varying the number and size of burner ports for a given port area. It is also noted that a small number of large ports provide a larger, fluttering flame which is similar to that produced by burning wood, while a large number of small ports provide a short, but well defined, relatively stable flame. However, when using a large number of small ports, there is less chance of flashback, flame lifting, and yellow tipping. Of course, in order for the flame to have an acceptable carryover between ports so that a uniform elongated flame is formed, it will be necessary to have the ports sufficiently close together.

With further reference to FIG. 4, it can be seen that two rows of ports 57*a* and 57*b* are located along the circumference of element 55. Flames 65*a* and 65*b* project from ports 57*a* and 57*b*. Flames 65*a* and 65*b* project from element 55 at an angle, causing the flames 65*a* and 65*b* to bend upwards under the influence of their natural buoyancy so as to respectively engage 59*a* and 59*b*. The secondary reaction zone 65*s* of flames 65*a* and 65*b* contact flamecoloring tubes 59*a* and 59*b*.

The separation of ports 57*a* and 57*b* on the circumference of element 55 can be determined by the angle between two imaginary planes which emanate from the axis 0 of element 55 and which intersect the wall 54 of element 55 at ports 57*a* and 57*b*. For example, an angle of 90° between the two planes would separate their points of intersection with wall 54 by one-fourth of the circumference of element 55.

Generally, element 55 will be situated so an imaginary vertical plane passing through axis 0 will bisect the angle between the forementioned planes which meet at axis 0; in other words, ports 57*a* would be located on one side of the vertical plane passing through axis 0 and ports 57*b* will be on the opposite side of the vertical plane from ports 57*a* and the distance between one vertical plane passing through axis 0 and ports 57*a* is equal to the distance between the vertical plane passing through axis 0 and parts 57*b*. The angle between the imaginary planes emanating from axis 0 and passing through ports 57*a* and 57*b* determines the angle at which flames will emanate from element 55.

Tubes 59*a* and 59*b* are laterally offset outwards from the imaginary vertical planes which pass through ports 57*a* and 57*b* so that tubes 59*a* and 59*b* remain in the center of the secondary reaction zone 65*s* of flames 65*a* and 65*b*. Secondary reaction zone 65*s* of flames 65*a* and 65*b* may also contact artificial logs 66*a* and 66*b*. The secondary reaction zones 65*s* of flames 65*a* and 65*b* which contact artificial logs 66*a* and 66*b* should already be colored due to its contact with tubes 59*a* and 59*b*; logs 66*a* and 66*b* further disburse the secondary reaction zone 65*s* in order to give flames 65*a* and 65*b* an appearance very similar to a flame produced by burning wood.

The size of flames 65*a* and 65*b* may be adjusted by controlling the amount of fuel entering element 55 through gas inlet 62, altering the size of ports 57*a* and 57*b*, adjusting the oxidant to fuel ratio, or changing the angle at which ports 57*a* and 57*b* project flames 65*a* and 65*b* from element 55.

A gas burner for use with the flame-coloring device of the present invention has been constructed using a ¾" nominal black iron pipe. Two rows of 36 ports each are located on the upper circumference of the pipe with the two rows separated by a distance equal to one-fourth of the circumference (determined by the intersections of two imaginary planes with the pipe circumference which also have a 90° angle of intersection with each other at the pipe axis).

Each port has an area of approximately 0.00528"$^2$. A suitable flame was produced when the burner had an input rate of 60,000 BTU/hour and a port loading of 158,000 BTU"$^2$. It is envisioned that burners made from other materials and having a wide variety of shapes and sizes may also be used with the gas flame-colorizing device. In addition, the number and size of ports may vary, or the ports may be replaced with one or more slots.

When flame-coloring device 70 is used in the manner described, a casual observer might easily confuse a fireplace utilizing the device with a wood-burning fireplace.

Although the preferred embodiments have been described and illustrated herein, it will be understood that various alterations, modifications and substitutions may be apparent to one of skill in the art without departing from the essential spirit of the invention. The scope of the invention is accordingly defined by the following claims.

I claim:

1. A flame-coloring device for use in the secondary reaction zone of flames, especially flames produced by gas burning fireplaces, comprising:

flame providing means for providing a flame having a mixing zone, a primary reaction zone and a secondary reaction zone;

support means situated in said secondary reaction zone;

a coating on said support means which resists degradation by said secondary reaction zone;

reactant means in said coating responsive to engagement with said secondary reaction zone of said flame to cause the color of said flame to be more yellow and orange than a gas flame; and wherein said coating is formed from:

soda lime glass;

aluminum oxide;

at least one of the group comprising $Na_2O.xSiO_2$ where $x=3-5$, $Na_2Si_2O_5$, $NaSiO_3.9H_2O$, and $Na_2SiO_3$; and at least one of the group comprising $Na_2CO_3$, and $NaHCO_3$.

2. A flame-coloring device for use in the secondary reaction zone of flames, especially flames produced by gas burning fireplaces, comprising:

flame providing means for providing a flame having a mixing zone, a primary reaction zone and a secondary reaction zone;

support means situated in said secondary reaction zone;

a coating on said support means which resists degradation by said secondary reaction zone; and reactant means in said coating responsive to engagement with said secondary reaction zone of said flame to cause the color of said flame to be more yellow and orange than a gas flame;

wherein said support means comprises a compound containing at least one of the group comprising $Al_2O_3$, and $3Al_2O_3.2SiO_2$.

3. A flame-coloring device for use in the secondary reaction zone of flames, especially flames produced by gas burning fireplaces, comprising:

flame providing means for providing a flame having a mixing zone, a primary reaction zone and a secondary reaction zone;

support means situated in said secondary reaction zone;

A coating on said support means which resists degradation by said secondary reaction zone;

reactant means in said coating responsive to engagement with said secondary reaction zone of said flame to cause the color of said flame to be more yellow and orange than a gas flame;

wherein said support means comprises at least two elongated hollow tubes, said flame providing means comprises a burner element having an elongated cylindrical shape; and further comprising:

a plurality of ports formed into at least two rows in said burner element, each being respectively positioned in different radial planes of said cylindrical shape so that said flame emanates from said ports to form at least two elongated flames projecting at an angle from each other.

4. A device according to claim 1, additionally including bracket means for holding said support means in said secondary reaction zone of said flame.

5. A device according to claim 1, wherein said reactant means comprises a compound containing at least one element which is a metal.

6. A device according to claim 1, wherein said reactant means comprises a compound containing at least one alkali or alkaline earth element, and whereby said element is ionized by said secondary reaction zoned of said flame, said ionized element causing colorization of said flame.

7. A device according to claim 5, wherein said element is sodium.

8. A device according to claim 5, wherein said element is calcium.

9. A device according to claim 1, wherein said coating further comprises:

adhesive means for firmly holding said coating to said support means, and wherein said coating resists degradation and flaking off of said support at the temperatures of said secondary reaction zone; and a reactant means release moderator for releasing said reactant means into said flame at a uniform rate whereby a uniform color is provided to said flame.

10. A device according to claim 1, wherein said support means comprises an elongated hollow tube.

11. A device according to claim 1, further comprising:

A decorative, fireproof assembly, wherein said flame-coloring device is positioned in said assembly to at least partially hide said support means and said coating on said support means from view.

12. A method for coloring gas flames, especially those produced in gas-burning fireplaces, comprising the steps of:

coating a support with a compound which remains stable at high operating temperatures, said compound containing a flame-coloring means release moderator;

placing said coated support in the secondary reaction zone of a flame, whereby said flame impinges upon said coating and causes said flame-coloring means to be released into said flame in a controlled fashion to provide a nearly constant natural flame color; and wherein:

said coating is prepared by:

forming a dry mixture of $Al_2O_3$, soda lime glass, and at least one of the compounds in the group comprised of $Na_2CO_3$ and $NaHCO_3$;

forming a gelatinous solution by adding to said dry mixture a warm solution saturated with at least one of the compounds in the group comprised of $Na_2SiO_3$, $Na_2SiO_5$, $Na_2O{\cdot}xSiO_2$ where $x=3-5$, and $NaSiO_3.9H_2O$;

applying said gelatinous solution to said support; and drying said gelatinous solution on said support to form said coating.

13. A method according to claim 12, wherein said coated support is dried by baking said coated support at a temperature between 200° F. and 600° F.

14. A method according to claim 13, wherein said coated support is baked at approximately 500° F. for approximately 15 minutes.

15. A method according to claim 13, wherein said coated support is placed in a vertical orientation during baking.

16. A method according to claim 12, wherein said coated support is hollow, and is placed in a location in said secondary reaction zone of said flame which has a temperature, measured from inside said support, which does not exceed approximately 1400° F.

17. A method according to claim 12, wherein said flames emanates upward from an elongated burner element located in a fireplace, said element having a tube with a plurality of ports formed in a row along the upper surface of said tube, said tube having a horizontal axis passing lengthwise through said tube and a first vertical plane which passes through said ports and said horizontal axis, wherein said coated support is placed in spaced vertical relationship with said ports in said first plane so that only said secondary reaction zone of said flame contacts said coated support.

18. A method of preparing gas flame-coloring means, comprising the steps of:

forming a dry mixture $Al_2O_3$, soda lime glass, and at least one of the compounds in the group comprising $Na_2CO_3$ and $NaHCO_3$;

forming a gelatinous solution by adding to said dry mixture a warm solution saturated with at least one of the compounds in the group comprising $Na_2SiO_3$, $Na_2Si_2O_5$ $Na_2O{\cdot}xSiO_2$ where $x=3-5$, and $NaSiO_3{\cdot}9H_2O$;

applying said gelatinous solution to a support; and drying said solution on said support to form said coating.

19. A method according to claim 18, wherein said coated support is dried by baking said coating support at a temperature between 200° F. and 600° F.

20. A method according to claim 19, wherein said coated support is baked at approximately 500° F. for approximately 15 minutes.

21. A method according to claim 19, wherein said coated support is placed in a vertical orientation during baking.

* * * * *